US009011137B2

(12) United States Patent
Garrett et al.

(10) Patent No.: US 9,011,137 B2
(45) Date of Patent: Apr. 21, 2015

(54) BLOCK FORMING APPARATUS AND METHOD

(75) Inventors: Robert Garrett, Calgary (CA); Arthur Garrett, Calgary (CA)

(73) Assignee: Magnum Forms Inc., Calgary (CA)

( * ) Notice: Subject to any disclaimer, the term of this patent is extended or adjusted under 35 U.S.C. 154(b) by 153 days.

(21) Appl. No.: 13/184,353

(22) Filed: Jul. 15, 2011

(65) Prior Publication Data

US 2013/0015601 A1 Jan. 17, 2013

(51) Int. Cl.

| | |
|---|---|
| ***B28B 7/08*** | (2006.01) |
| ***B28B 7/18*** | (2006.01) |
| ***B28B 7/00*** | (2006.01) |
| ***B28B 7/02*** | (2006.01) |

(52) U.S. Cl.

CPC ..... *B28B 7/183* (2013.01); *B28B 7/0041* (2013.01); *B28B 7/0044* (2013.01); *B28B 7/0073* (2013.01); *B28B 7/02* (2013.01); *B28B 7/08* (2013.01)

(58) Field of Classification Search

CPC ..... B28B 7/08; B28B 1/02; B28B 1/44; B28B 7/0041; B28B 7/0044; B28B 7/0073; B28B 7/02; B28B 7/183

USPC ..... 425/402, 413, 414, 418, 422, 428, 431, 425/435, 439, 441, 442, 444, 436 RM, 425/450.1, 460, 466–468, 443, 449, 454; 249/112, 113, 140, 142, 158, 160–163, 249/165–172, 177; 264/333, 334, 336

See application file for complete search history.

(56) References Cited

U.S. PATENT DOCUMENTS

| | | | | |
|---|---|---|---|---|
| 754,550 A | | 3/1904 | Dunn | |
| 788,739 A | * | 5/1905 | Throckmorton | 249/64 |
| 877,874 A | * | 1/1908 | Tsanoff | 249/125 |
| 1,151,309 A | * | 8/1915 | Urban | 249/137 |
| 1,442,122 A | * | 1/1923 | Brown | 425/218 |
| 1,493,744 A | * | 5/1924 | Ferguson | 264/72 |
| 1,569,257 A | * | 1/1926 | Boes | 425/412 |
| 1,574,565 A | * | 2/1926 | Ferguson | 425/432 |
| 1,584,920 A | * | 5/1926 | Flint et al. | 249/172 |

(Continued)

FOREIGN PATENT DOCUMENTS

| | | | | |
|---|---|---|---|---|
| GB | 589126 | * | 6/1947 | B28B 7/18 |
| GB | 2308327 A | * | 6/1997 | B28B 11/24 |

(Continued)

OTHER PUBLICATIONS

Translation of SU 1133102 A (date is not applicable).*

*Primary Examiner* — Dimple Bodawala

(74) *Attorney, Agent, or Firm* — Workman Nydegger

(57) ABSTRACT

A mold and method for making a hollow core concrete block. The mold has two opposing side walls; a bottom wall; a front wall; a top side with an opening through which the block can be removed from the mold; a cover, and a rear side through which liquid, such as concrete, can be poured into the mold. Extending from the two side walls are a pair of trunnions about which the mold is rotatable, such that when the mold is suspended by the trunnions and the mold is empty, gravity rotates the mold from a block-removal orientation in which the top side faces upwards to a mold-filling orientation in which the rear side faces upwards. The trunnions are also positioned such that when the mold is filled with the liquid, gravity rotates the mold from the mold-filling orientation to the block-removal orientation.

12 Claims, 18 Drawing Sheets

(56) References Cited

U.S. PATENT DOCUMENTS

| | | | | | |
|---|---|---|---|---|---|
| 1,645,776 | A | * | 10/1927 | Sanson | 249/104 |
| 2,280,635 | A | * | 4/1942 | Ishman | 249/85 |
| 2,473,748 | A | | 6/1949 | Green | |
| 2,477,320 | A | | 7/1949 | Tyroler | |
| 2,540,199 | A | * | 2/1951 | Gorlinski | 249/137 |
| 2,582,161 | A | * | 1/1952 | Randall | 425/424 |
| 2,772,467 | A | * | 12/1956 | Muspratt | 425/409 |
| 2,903,777 | A | * | 9/1959 | Mitchell | 425/439 |
| 3,080,636 | A | * | 3/1963 | Zerlaut | 425/439 |
| 3,259,679 | A | * | 7/1966 | Nielsen | 264/242 |
| 3,348,802 | A | * | 10/1967 | Corbett | 249/163 |
| 3,570,801 | A | * | 3/1971 | Moritz et al. | 249/166 |
| 3,659,986 | A | * | 5/1972 | Gelbman | 425/88 |
| 3,694,128 | A | | 9/1972 | Foxen | |
| 3,837,613 | A | | 9/1974 | Sontag | |
| 4,008,034 | A | * | 2/1977 | Kane | 425/441 |
| 4,080,129 | A | * | 3/1978 | Little | 425/85 |
| 4,289,293 | A | * | 9/1981 | Cashion | 249/74 |
| 4,560,335 | A | * | 12/1985 | Cordova et al. | 425/62 |
| 4,660,344 | A | * | 4/1987 | Gaudelli et al. | 52/592.1 |
| 5,126,095 | A | * | 6/1992 | Crosno et al. | 264/516 |
| 5,281,125 | A | * | 1/1994 | Gebhardt | 425/253 |
| 5,397,228 | A | * | 3/1995 | Metten | 425/290 |
| 6,620,364 | B2 | * | 9/2003 | Gresser et al. | 264/219 |
| 6,827,570 | B2 | * | 12/2004 | Sumrall et al. | 425/219 |
| 7,207,146 | B1 | * | 4/2007 | Morrell | 52/561 |
| 7,341,685 | B2 | * | 3/2008 | Hamilton et al. | 264/219 |
| 7,553,109 | B2 | * | 6/2009 | Blundell | 405/286 |
| 7,942,658 | B1 | * | 5/2011 | Jensen | 425/4 R |
| 8,317,502 | B1 | * | 11/2012 | Grey | 425/63 |
| 8,790,109 | B1 | * | 7/2014 | Brownson | 425/435 |
| 8,888,481 | B2 | * | 11/2014 | O'Neill et al. | 425/438 |
| 2001/0026734 | A1 | * | 10/2001 | Manthei | 405/284 |
| 2006/0175724 | A1 | * | 8/2006 | Linares | 264/69 |
| 2012/0025422 | A1 | * | 2/2012 | Manthei | 264/313 |
| 2012/0139163 | A1 | * | 6/2012 | Garfinkel et al. | 264/336 |
| 2012/0175814 | A1 | * | 7/2012 | O'Neill et al. | 264/299 |
| 2012/0199721 | A1 | * | 8/2012 | Van Lerberg et al. | 249/160 |

FOREIGN PATENT DOCUMENTS

| | | | | | |
|---|---|---|---|---|---|
| JP | 06099420 | A | * | 4/1994 | B28B 7/18 |
| JP | 11286003 | A | * | 10/1999 | B28B 7/00 |
| SU | 1133102 | A | * | 1/1985 | B28B 7/04 |
| SU | 1310214 | A1 | * | 5/1987 | B28B 7/24 |
| SU | 1465334 | A1 | * | 3/1989 | B28B 7/22 |

* cited by examiner

BLOCK FORMING APPARATUS AND METHOD

TECHNICAL FIELD

The present invention relates to a method and a mold for making a block. More particularly, the present invention relates to a method and a mold for making a hollow core concrete block that has imprinted on one side of it a decorative pattern.

BACKGROUND

Concrete blocks, and in particular hollow core concrete blocks, have several purposes. For example, they can be stacked in order to compress the ground beneath them in advance of building on the ground. They can also be stacked adjacent to an embankment and used to construct a retaining wall in order to stabilize the embankment.

Accordingly, given the usefulness of concrete blocks in industries such as construction, research and development continues into efficient, robust, and reliable ways to construct concrete blocks.

SUMMARY

The present invention comprises a mold and a method for making a block, such as a hollow core concrete block. The mold has two opposing side walls; a bottom wall; a front wall; a top side that has an opening through which the block can be removed from the mold; a cover that can be used to seal the top side; and a rear side through which liquid, such as concrete, can be poured into the mold. Extending from the two side walls are a pair of trunnions about which the mold is rotatable. The trunnions are positioned on the mold such that when the mold is suspended by the trunnions and the mold is empty, gravity rotates the mold from a block-removal orientation in which the top side faces upwards to a mold-filling orientation in which the rear side faces upwards. The trunnions are also positioned such that when the mold is filled with the liquid, gravity rotates the mold from the mold-filling orientation to the block-removal orientation.

Making the block using the mold can be done by sealing the mold except for the rear side; suspending the mold to transition the mold to the mold-filling orientation; pouring the liquid into the mold, letting the block cure; suspending the mold to transition the mold to the block-removal orientation; removing a cover from the top side of the mold; and then lifting the block out of the mold.

Accordingly, in a first broad aspect of the present invention, such invention comprises a mold for making a block, the mold comprising:

(a) two opposing side walls each having a trunnion about which the mold is rotatable that extends away from the interior of the mold, wherein the trunnions are positioned on the side walls such that when the mold is suspended by the trunnions gravity rotates the mold towards a mold-filling orientation when the mold is empty and from the mold-filling orientation towards a block-removal orientation when the mold is filled with a liquid of a certain density;

(b) a bottom wall sealingly engageable with the side walls;

(c) a front wall sealingly engageable with the bottom and side walls;

(d) a top side having an opening through which the block can be removed from the mold, wherein the top side faces upwards when the mold is in the block-removal orientation;

(e) a cover sealingly engageable on the top side with the bottom and side walls; and (f) a rear side through which the liquid can be poured into the mold, wherein the rear side faces upwards when the mold is in the mold-filling orientation.

BRIEF DESCRIPTION OF THE DRAWINGS

In the accompanying drawings, which illustrate one or more exemplary embodiments:

FIG. 7(*b*) is a right sectional view of the mold of FIG. 1 along line 7(*b*)-7(*b*) of FIG. 3.

FIG. 8(*b*) is a left sectional view of the mold of FIG. 1 along line 8(*b*)-8(*b*) of FIG. 3.

DETAILED DESCRIPTION

Directional terms such as "top," "bottom," "upwards," "downwards," "vertically" and "laterally" are used in the following description for the purpose of providing relative reference only, and are not intended to suggest any limitations on how any article is to be positioned during use, or to be mounted in an assembly or relative to an environment.

The variety of purposes for which concrete blocks can be used contributes to their ubiquity. In order to facilitate transport and economic manufacture, concrete blocks are often manufactured with a hollow core. These hollow core concrete blocks are often seen, for example, at construction sites and lining embankments along the sides of highways and other roads. Typically, a relatively large number of these blocks are stacked on top of each other to form walls, including retainer walls for sloped embankments. Accordingly, there exists continued demand for efficient and reliable ways to make hollow core concrete blocks in relatively large numbers.

Additionally, because hollow core concrete blocks are often used while in public view, it is desirable to make them aesthetically pleasing. To do this, a decorative textured or contoured pattern can be imprinted on to the front faces of the blocks. Imprinting the concrete blocks with the textured pattern introduces technical problems to the block manufacturing process. For example, the textured surface used to imprint the decorative pattern into the blocks can act as an obstacle when the block is being removed from a mold. Additionally, the textured surface can trap air bubbles in the blocks during the curing process, which can reduce the structural integrity of the blocks.

Figure 15:
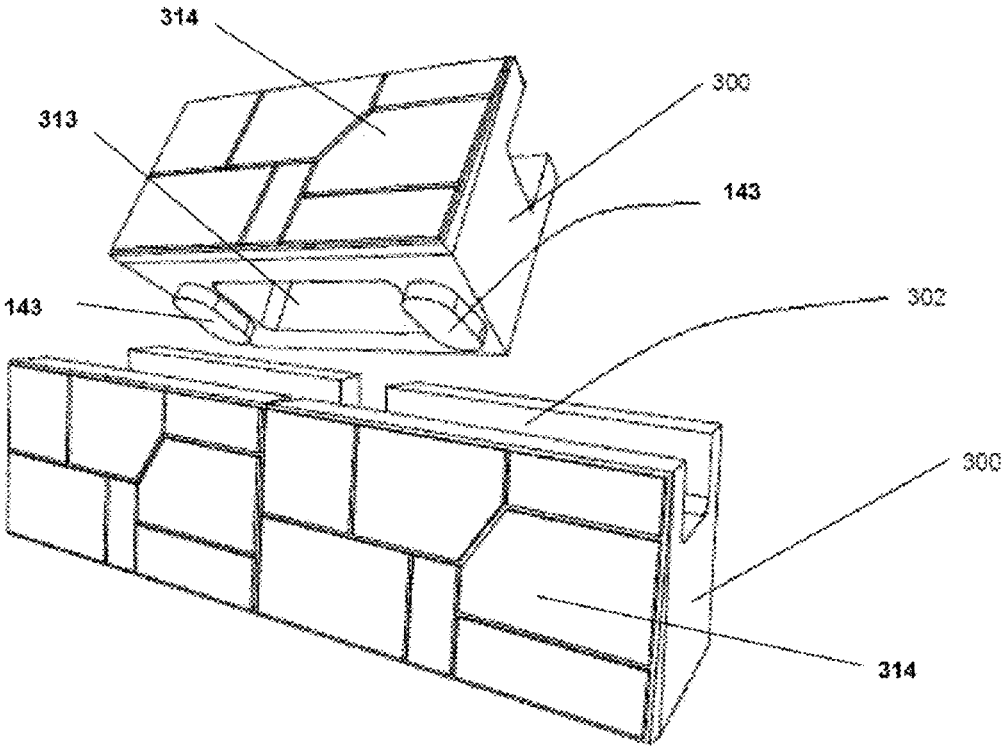
FIG. 15 is a partially-exploded perspective view of a retaining wall, formed from blocks made using the concrete form and method of the present invention, showing the manner of interlocking of the feet within the hollow core of each of two lower blocks.

The following embodiments are directed at a mold and a method for making blocks, and in particular, hollow core concrete blocks 300 that have a decorative, textured face 314 (see FIG. 15). The mold includes trunnions by which the mold can be suspended and about which the mold can rotate. The mold includes a front wall, the interior of which is lined by a textured surface, and that is pivotable between opened and closed positions. The mold is designed to have a center of gravity such that when it is suspended by the trunnions and the mold is empty, it tends to rotate such that the front contoured wall faces downwards. When the front face of the mold is facing downwards, liquid concrete can be poured into the mold and onto the contoured surface of the mold, which is a much more preferable position for ensuring concrete becomes imprinted with the contoured surface than if the mold was positioned in the upright position with the contoured surface on the side of the mold. Following pouring, the mold can be vibrated, which causes air bubbles to rise through and out of the concrete. Once the concrete has cured, the mold can again be suspended by the trunnions. The center of gravity of the mold containing the concrete is then located such that when the mold is filled and suspended, the front wall containing the contoured surface faces forwards, and the block is in the normal upright position. The front wall of the mold can then be opened so that the textured surface is moved such that the block can be lifted out of the mold unimpeded.

Figure 1:
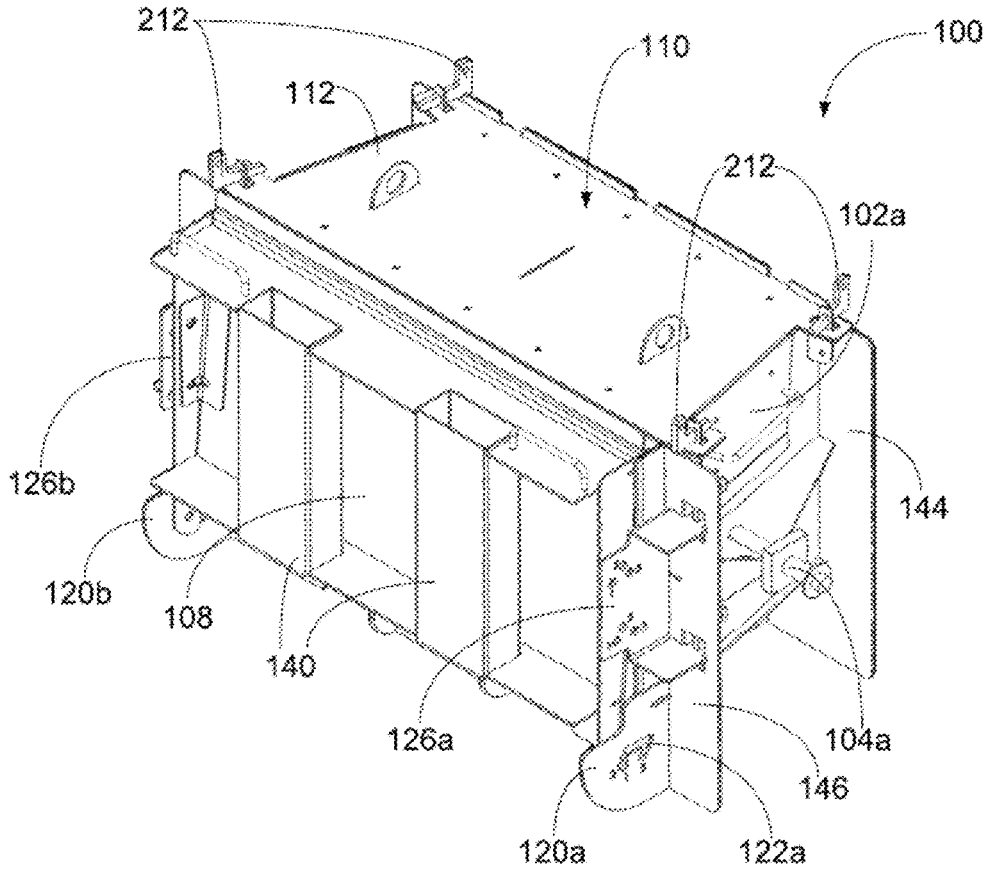
FIG. 1 is a top perspective view of a mold for making a hollow core concrete block of the present invention, according to one embodiment.
Figure 2:
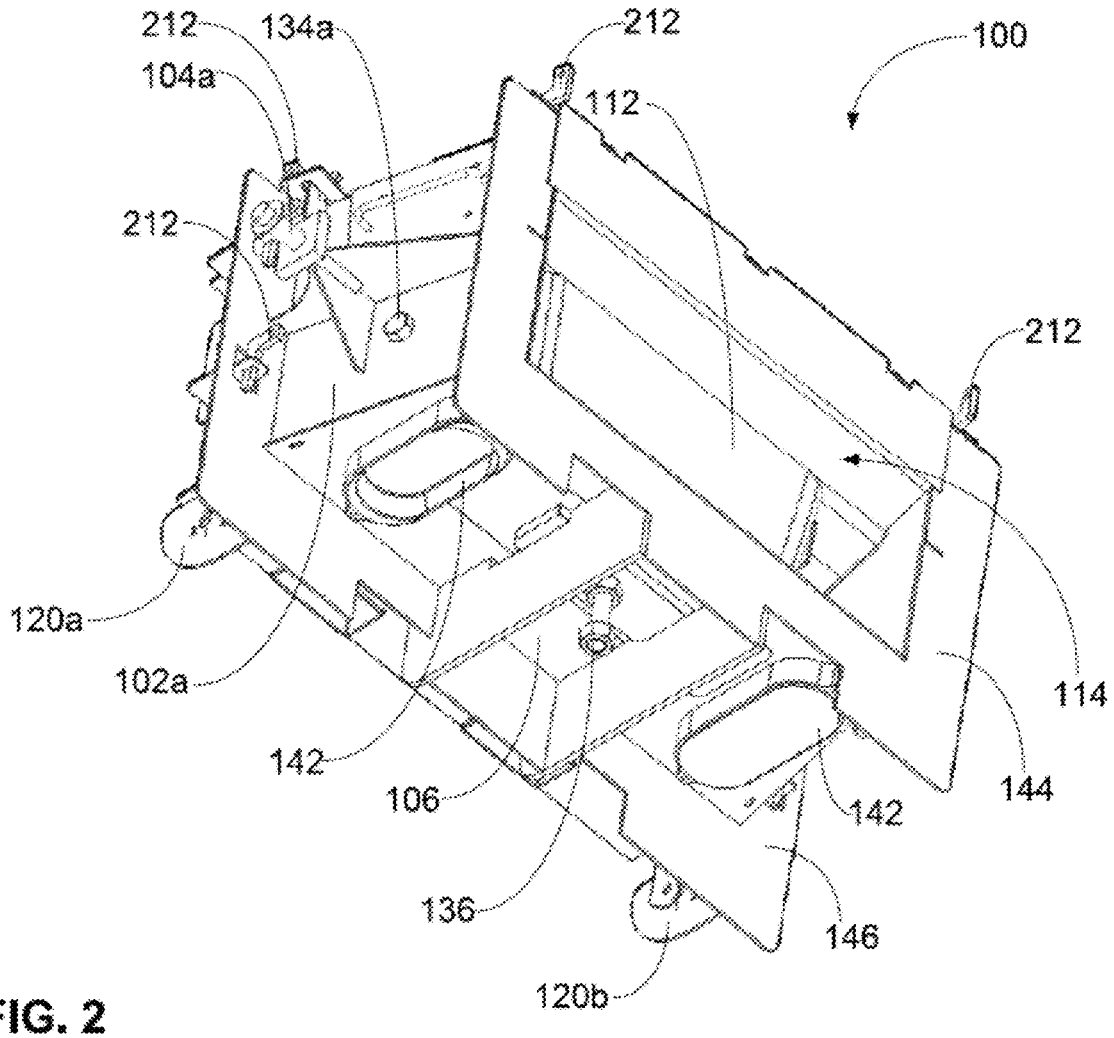
FIG. 2 is a bottom perspective view of the mold of FIG. 1.
Figure 3:
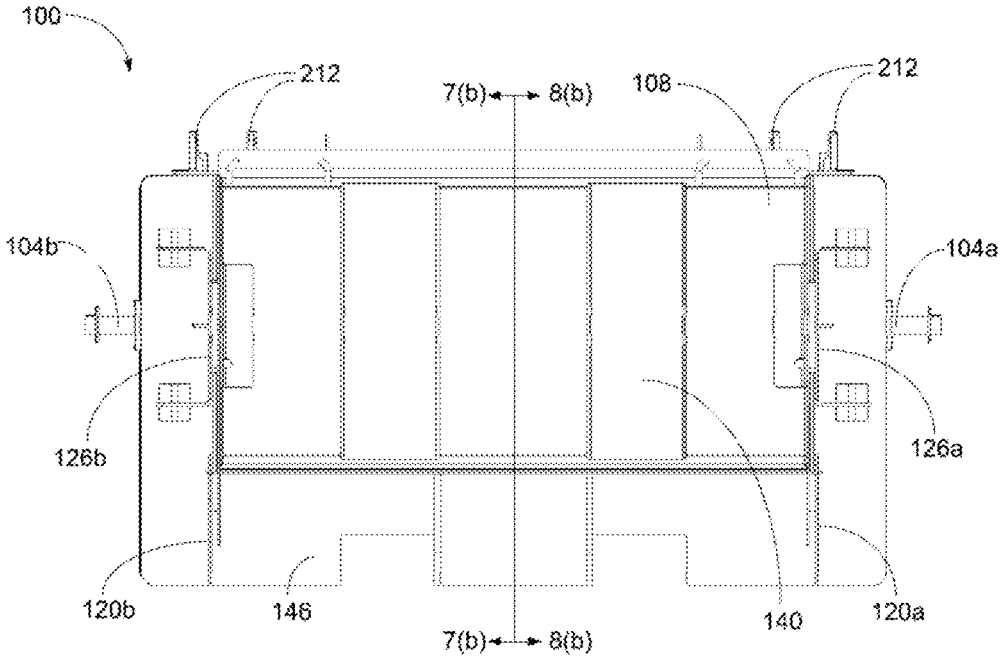
FIG. 3 is a front elevation view of the mold of FIG. 1
Figure 4:
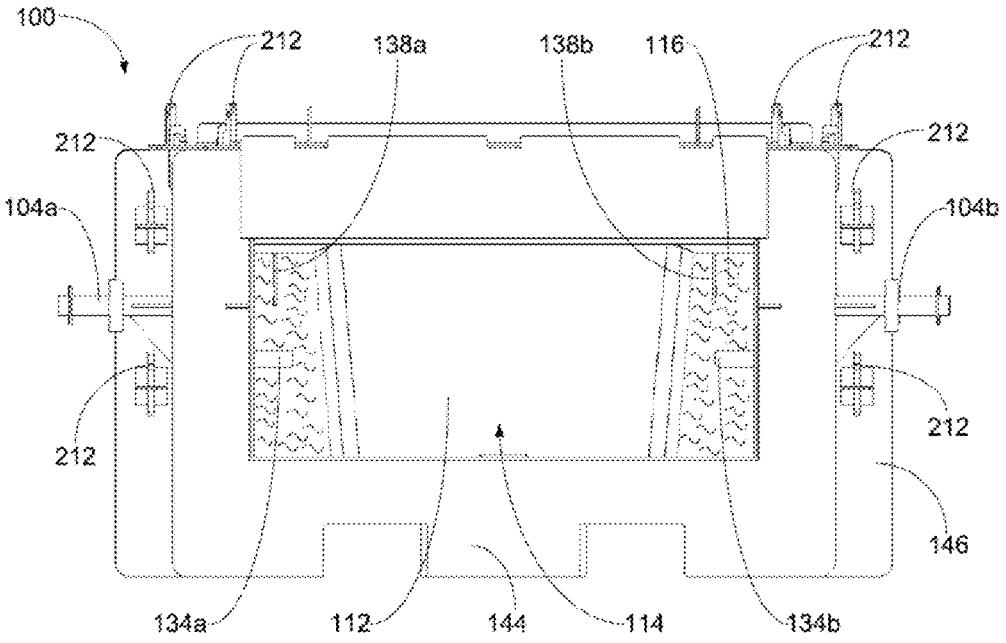
FIG. 4 is a rear elevation view of the mold of FIG. 1.
Figure 5:
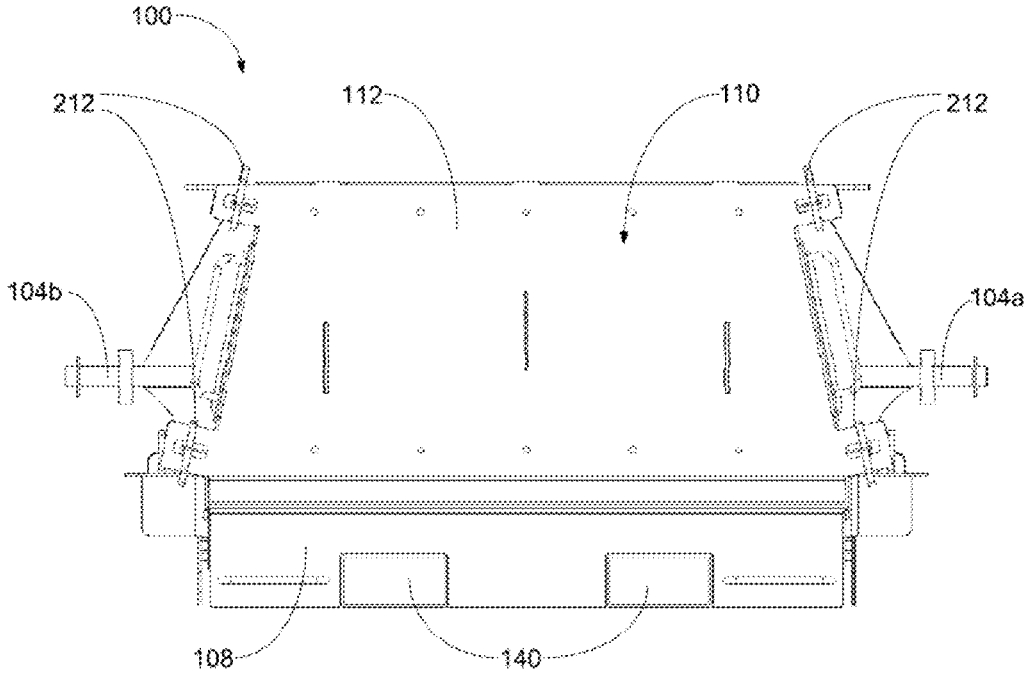
FIG. 5 is a top plan view of the mold of FIG. 1.
Figure 6:
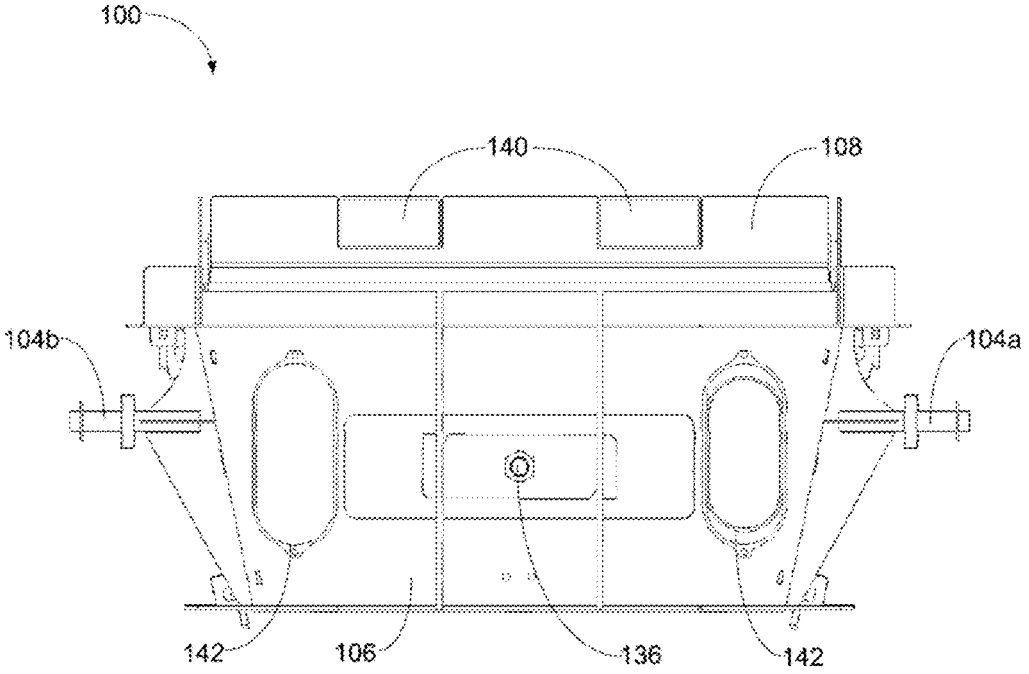
FIG. 6 is a bottom plan view of the mold of FIG. 1.
Figure 7A:
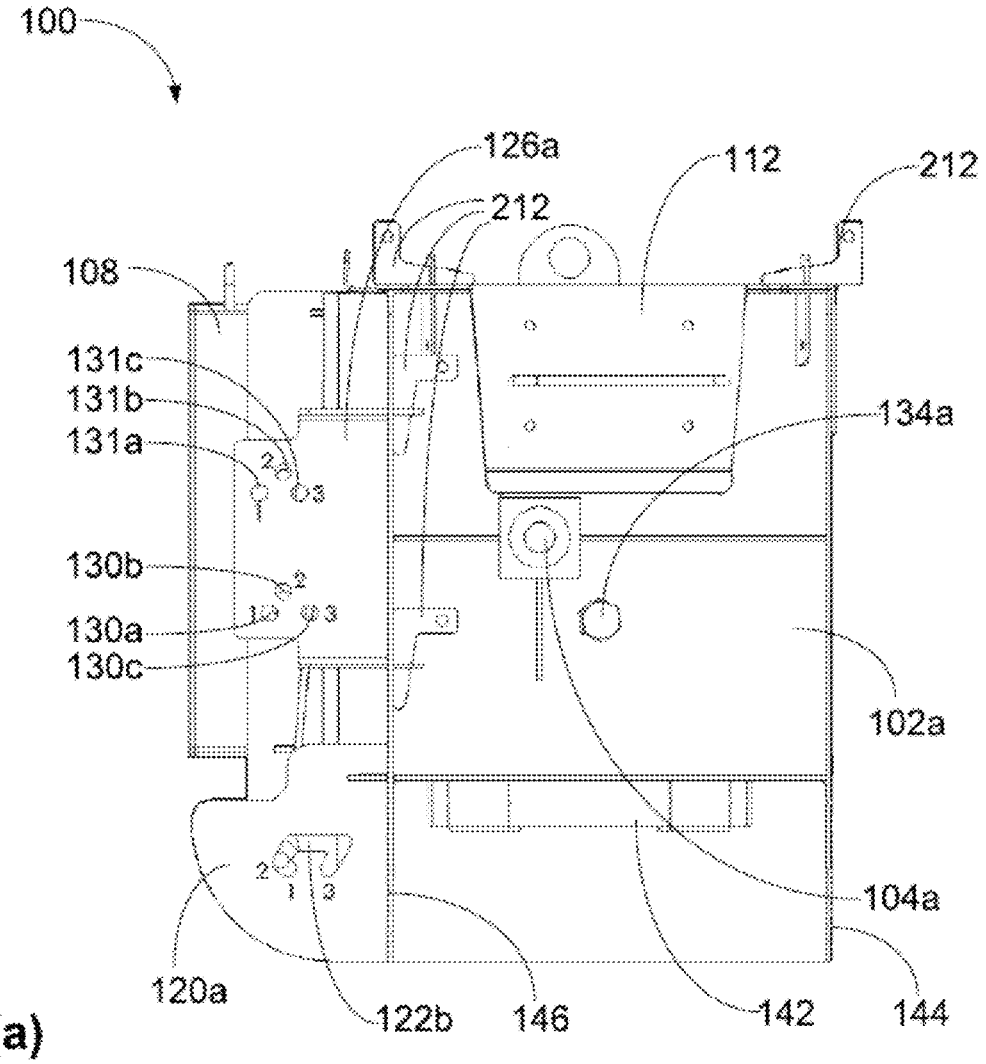
FIG. 7(*a*) is a right side elevation view of the mold of FIG. 1.
Figure 7B:
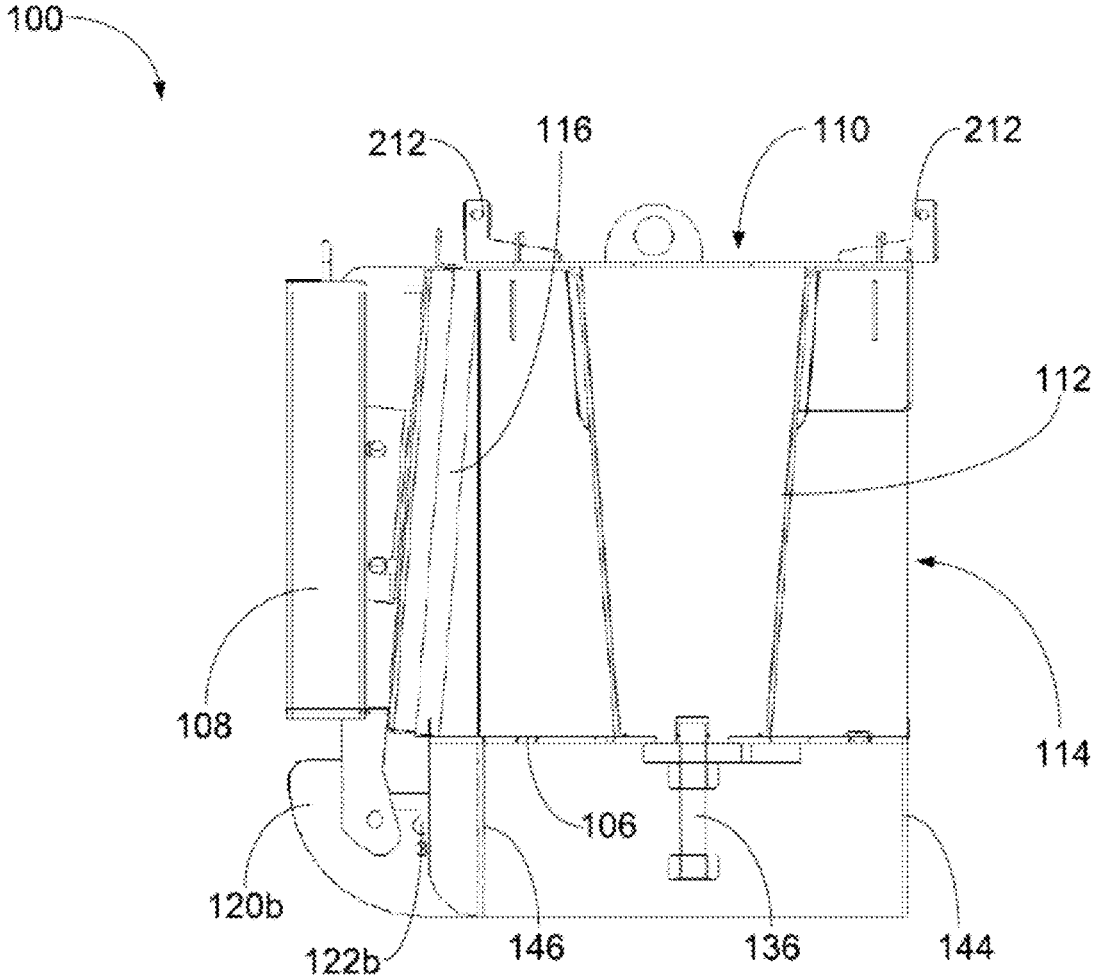

Referring now to FIGS. 1 to 8(*b*) and to a first embodiment, there is shown a mold 100 for making a hollow core concrete block. FIGS. 1 to 8(*b*) depict various views of the mold 100: FIGS. 1 & 2 are perspective views of the mold 100; FIGS. 3 & 4 are front and rear elevation views of the mold 100, respectively; FIGS. 5 & 6 are top and bottom plan views of the mold 100, respectively; FIGS. 7(*a*) & 8(*a*) are left and right side elevation views of the mold 100, respectively; and FIGS. 7(*b*) & 8(*b*) are left and right sectional views of the mold 100, respectively.

Figure 9:
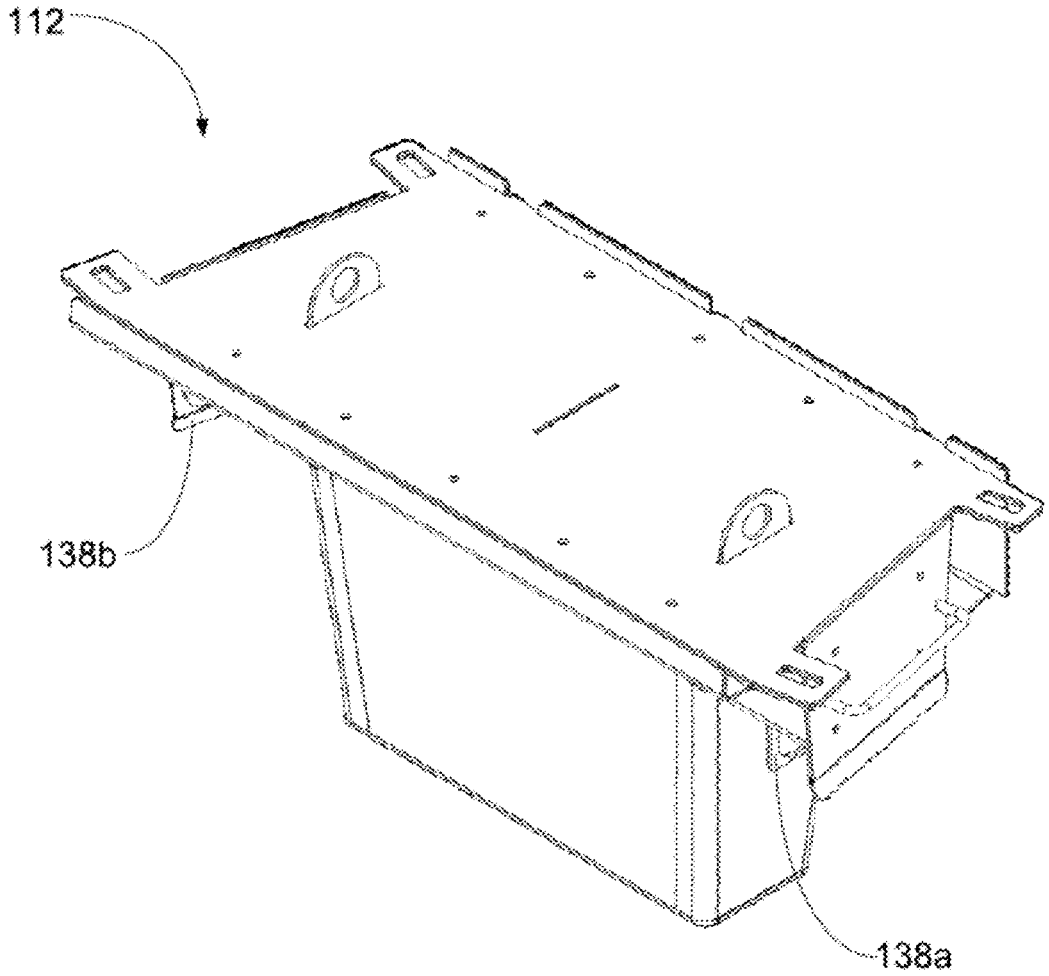
FIG. 9 is a top perspective view of a hollow core insert that can be inserted into and act as a cover for the mold of FIG. 1.
Figure 10:
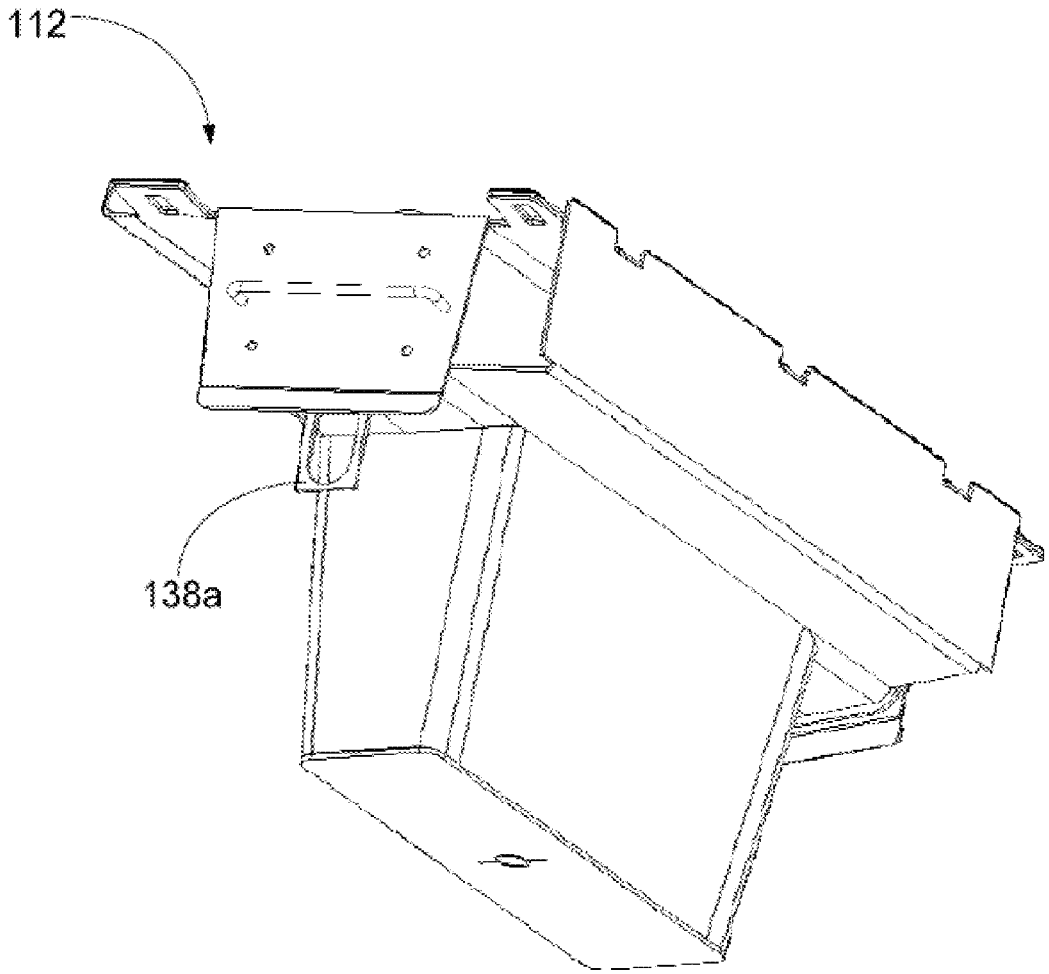
FIG. 10 is a bottom perspective view of the hollow core insert of FIG. 9.

The mold 100 has six sides: a front side (i.e. front wall 108), a rear side 114/144, a top side 110, a bottom side (i.e. bottom wall 106), a left side (i.e. left side wall 102*b*), and a right side (i.e. right side wall 102*a*). Extending along three edges of the rear side 114 is a rear lip 144, while extending along three edges of the front side is a front lip 146. In FIGS. 1 to 8(*b*), a front wall 108, partially circumscribed by the front lip, 146, covers a portion of the front side; a right side wall 102*a* and a left side wall 102*b* (collectively, the side walls 102) cover the right and left sides, respectively; and a bottom wall 106 covers the bottom side. The top side 110 of the mold 100 is open and a hollow core insert 112, shown in more detail in FIGS. 9 & 10, is insertable into the mold 100 through the top side 110; in FIGS. 1 to 8(*b*), the hollow core insert 112 is fully inserted into the mold 100. A portion of the rear side 114 partially delineated by the rear lip 144 is uncovered, and in FIGS. 2 & 4 a portion of the hollow core insert 112 that is positioned in the interior of the mold 100 is visible through the uncovered rear side 114.

Figure 13:
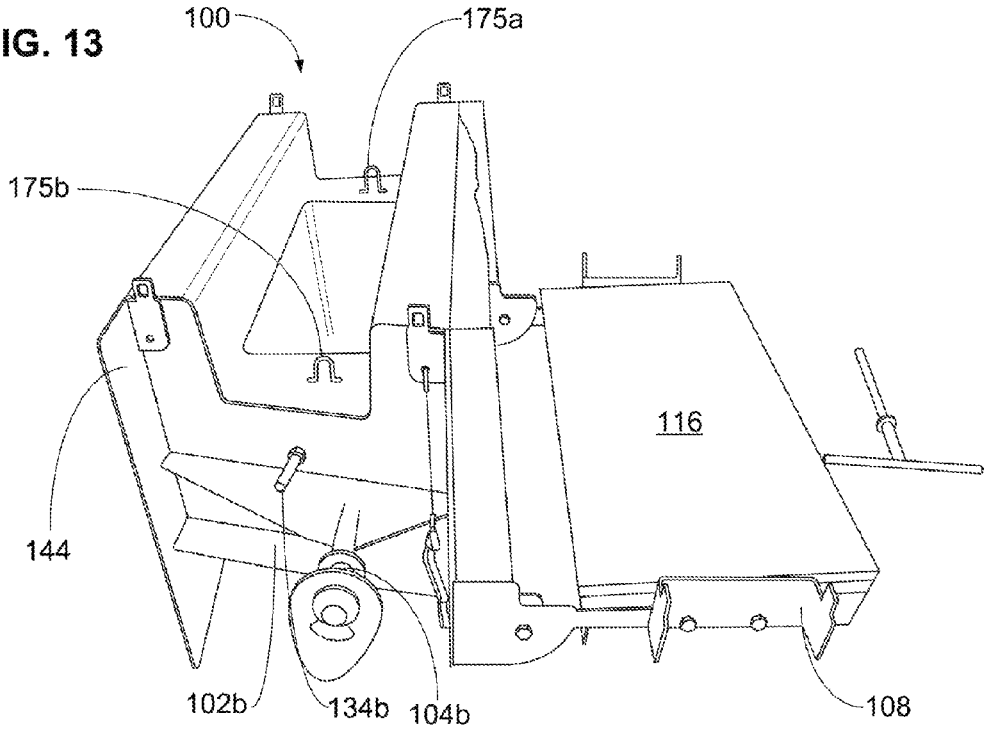
FIG. 13 is a perspective view of the mold of FIG. 12 in which the mold is shown as being in a block-removal orientation, (i.e. normal block-removal position) with a front wall of the mold containing a contoured surface in an opened position.
Figure 14:
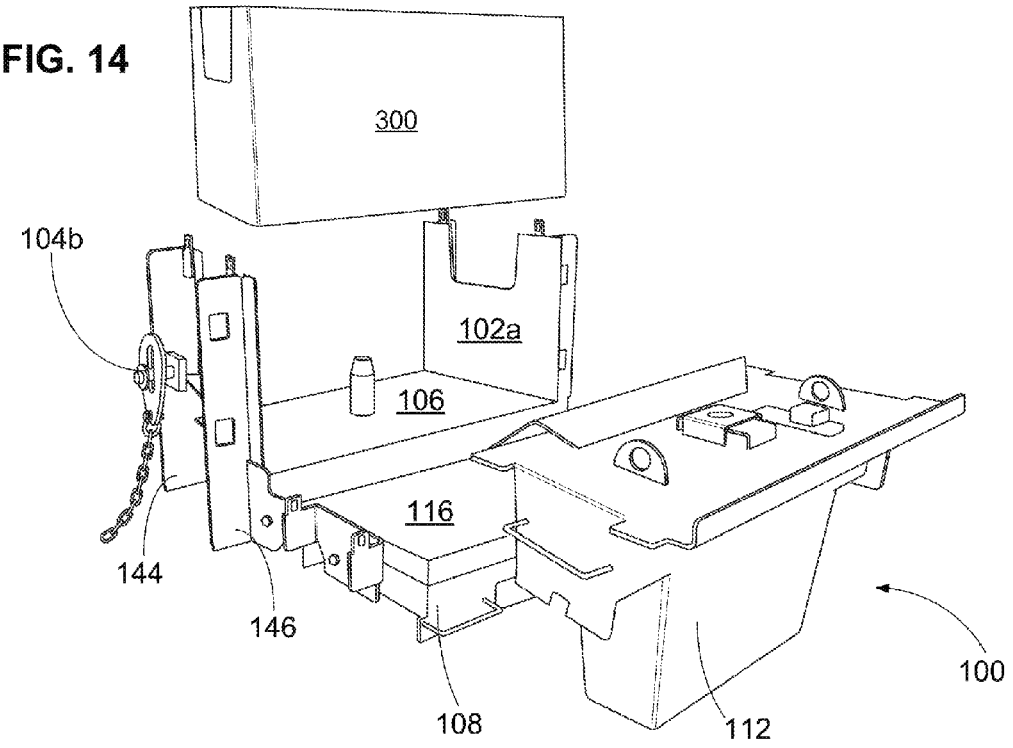
FIG. 14 is a perspective view of the mold of FIG. 12 in which the mold is again shown as being in the block-removal orientation with the front wall of the mold opened, and in which the hollow core concrete block is being lifted out of the mold, and the cover having being removed and which appears in the foreground.

Extending forwardly from opposing sides of the front lip 146 are a right pivot plate 120*a* and a left pivot plate 120*b* (collectively, "pivot plates 120") (see FIG. 1). The pivot plates 120 are each indirectly coupled to the side walls 102 via the front lip 146 and, in alternative embodiments (not depicted), form part of the side walls 102 or are directly coupled to the side walls 102. The right pivot plate 120*a* has one slot 122*a* and the left pivot plate has another slot 122*b* (the slots 122*a,b* are hereinafter collectively referred to as the "slots 122"), each of which is aligned with a corresponding aperture in opposing sides of the front wall 108. A pivot pin (not shown) can be inserted through each of the slots 122 and into the opposing sides of the front wall 108. The front wall 108 can accordingly be pivoted between a closed position, which is shown in FIGS. 1 to 8(*b*), and an opened position shown in FIGS. 13 & 14. FIGS. 13 & 14 show another embodiment of the mold 100 in which the exterior side of the front wall 108 is perpendicular with the bottom wall 106 of the mold 100, wherein in the embodiment shown in FIGS. 1-8(*b*) such front wall 108 is not completely perpendicular but rather angled. When the mold 100 is properly used, concrete is only poured into the mold 100 when the front wall 108 is in the closed position.

Lining the interior side of the front wall 108 is a textured surface 116, which extends into the interior of the mold 100 when the front wall 108 is closed. The "interior" of the mold 100 refers to volume contained within the six sides of the mold 100 when the front wall 108 is in the closed position. As the textured surface 116 extends into the interior of the mold 100 when the front wall 108 is closed, any block formed using the mold will have imprinted on its front face a decorative, textured pattern corresponding to the pattern on the textured surface 116. When the front wall 108 is pivoted into the opened position, the textured surface 116 is moved outside the interior of the mold 100.

Positioned on the opposing sides of the front wall 108 are a right adjustable batter draft plate 126*a* and a left adjustable batter draft plate 126*b* (collectively, "adjustable batter draft plates 126"). Wedge-shaped portions of the batter draft plates 126 extend through apertures in the front lip 146 when the front wall 108 is closed, and the front wall 108 can be secured in the closed position by using a wedge and pin fastening system (unlabelled).

The adjustable batter draft plates 126 can be used to adjust the batter draft of the front face of the blocks formed using the mold 100. For any given one of the blocks, the "batter draft" of the block refers to the angle the front face of the block makes relative to an axis perpendicular to the bottom face of the block. As is evident with reference to the sectional views of FIGS. 7(*b*) & 8(*b*), the batter draft of the blocks can be adjusted by adjusting the angle the textured surface 116 makes relative to the bottom wall 106. Each of the adjustable batter draft plates 126 and the three slots 122 (numbered 1, 2 & 3) is configured to allow the batter draft of the blocks formed using the mold 100 to be adjusted.

Each of the slots 122 in the pivot plates 120 has three positions in which the pivot pin can be retained; these three positions are labelled "1," "2," and "3" on the pivot plates 120.

Figure 16:
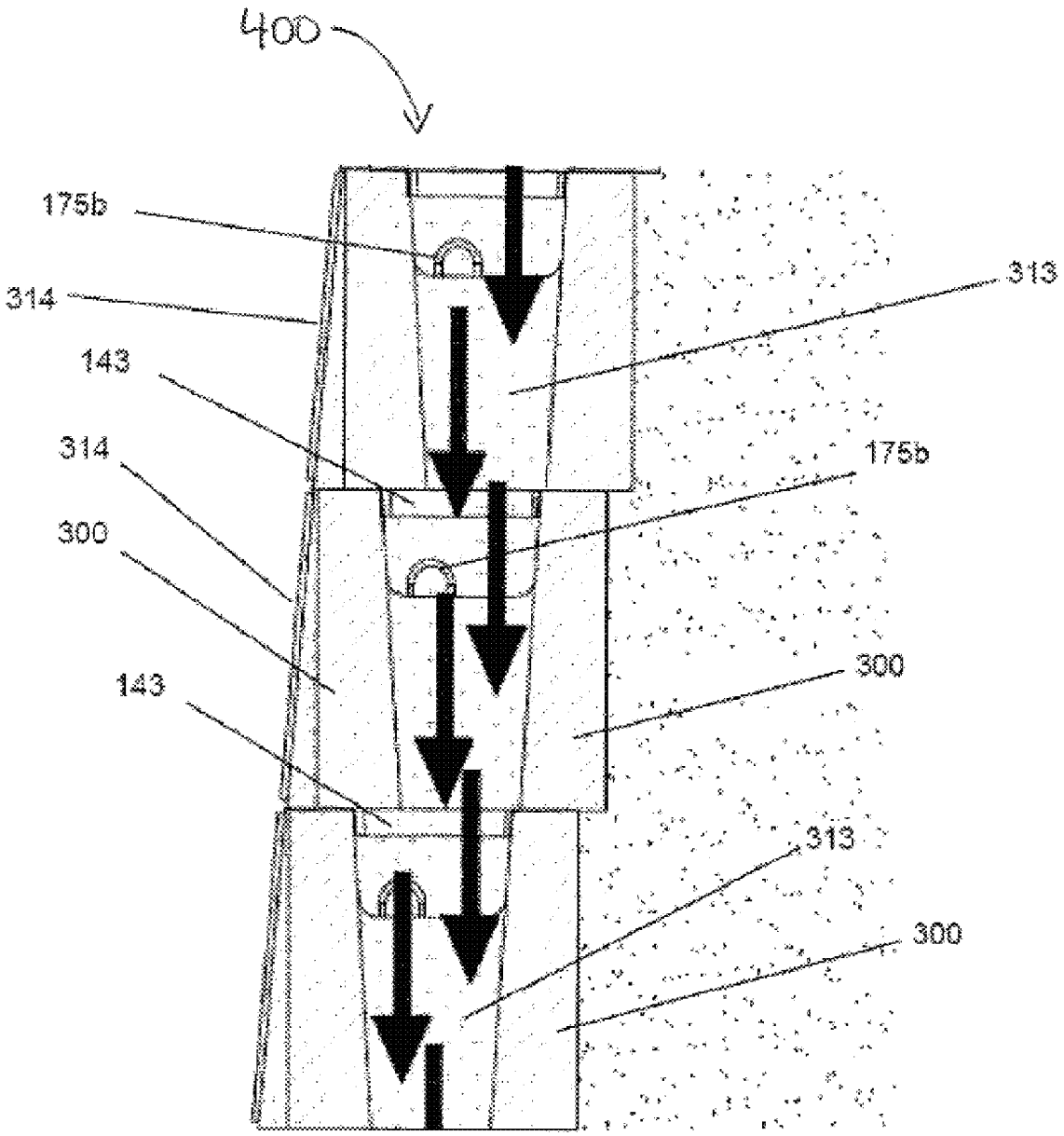
FIG. 16 is a side cross-sectional view of a retaining wall, formed from blocks made using the concrete form and method of the present invention, further showing the batter angle of the blocks and the wall so formed, as well as the manner of interlocking.

Each of the adjustable batter draft plates 126*a, b* includes two sets of groupings of three apertures each: the right adjustable batter draft plate 126*a* includes one set of apertures 130*a-c* and another set of apertures 131*a-c*, while the left adjustable batter draft plate 126*b* includes a third set of apertures 128*a-c* and a fourth set of apertures 129*a-c*. As indicated in the Figures, each of the apertures in the sets of apertures 128*a-c*, 129*a-c*, 130*a-c*, and 131*a-c* (hereinafter collectively referred to as the "sets of apertures 128-131") is labelled either "1," "2," or "3." Each of the apertures in the sets of apertures 128-131 can be aligned with a corresponding aperture that is present in each of the opposing sides of the front wall 108 and can be coupled to the front wall 108 by inserting batter draft adjustment bolts (not shown) through the aligned apertures to secure the respective batter draft plates 126*a*, 126*b* to front wall 108. The labels "1," "2," and "3" for the sets of apertures 128-131 and the slots 122 correspond to different batter drafts or different block depths. When the mold 100 is used, the pivot pins are inserted through the slots 122, and the batter adjustment bolts (not shown) inserted into the respective sets of apertures 128-131 in one of the three positions "1," "2," and "3." For example, when the front wall 108 is secured in position "2," the batter draft of the blocks formed using the mold 100 is shown by the angle of the textured surface 116 of approximately 5° as shown in FIGS. 7(*b*) & 8(*b*). When the front wall 108 is secured in positions "1" or "3," the batter draft angle of the front surface of any block 300 formed using the mold 100 may thereby be altered to a greater or lesser value. FIG. 16 shows a retainer wall 400 formed from blocks 300, which are each formed by the mold 100 of the present invention, where a mold 100 having an adjustable batter angle adjusted to provide a batter angle of 5° was used. As may be seen from FIG. 15 and FIG. 16, the feet 143 of block 300 have a lateral (horizontal) offset, and when positioned (spigotted) in hollow space 313 (which is dimensioned to receive therewith such feet 143) of a first upper block 300 and a second lower block 300, allows a lower portion of textured face 314 of the upper block 300 to be aligned with an upper portion of a textured face 314 of the lower block 300 on which the upper block 300 rests.

As best seen from FIGS. 13 and 14, the front wall 108 of the mold 100 also has on its exterior side forklift slots 140 for forklift hooks 175*a*, 175*b* which a motorized forklift can be used to move the mold 100 (see FIGS. 13 & 14).

Referring now in particular to FIGS. 9 & 10, there are shown top and bottom perspective views, respectively, of the hollow core insert 112 that is inserted into the interior of the mold 100 through the top side 110 of the mold 100 in FIGS. 1 to 8(*b*). The hollow core insert 112 further acts as a cover for the mold 100 when concrete is being poured into it through the open rear side 114, and prevents the liquid concrete from escaping out through the top side of the mold 100. On the bottom of the hollow core insert 112 are a right hook portion 138*a* and a left hook portion 138*b* (collectively, the "hook portions 138") that result in hooks 175*a*, 175*b* being present on the top side of the block formed using the mold 100. As discussed in further detail below in respect of FIGS. 11 to 14, these hooks 175*a*, 175*b* are used to lift the block from the mold 100 after curing is finished.

Referring back to FIGS. 1 to 8(*b*), a wedge and pin fastening system 212 is shown, which fastens the hollow core insert 112 to the side walls 102 of the mold 100. The right side wall 102*a* has a right trunnion 104*b* extending outwards from it and a right lug 134*a* which, when unscrewed, allows air to enter the interior of the mold 100. The left side wall 102*b* similarly has a left trunnion 104*b* and a left lug 134*b* (collectively, the right and left trunnions 104*a,b* are hereinafter the "trunnions 104" and the right and left lugs 134*a,b* are hereinafter the "lugs 134"). When the block is ready to be removed from the mold 100, the lugs 134 are opened, which consequently helps prevent formation of a vacuum that would resist attempts to remove the block from the mold 100.

When the mold 100 is used, it typically alternates between two orientations: (1) a mold-filling orientation (see FIG. 13), into which position the mold 100 rotates when not filled; and (2) a block-removal orientation (see FIGS. 1,2 7(*a*), 8(*a*), 13 & 14) into which the mold 100 will rotate once filled with concrete. In the mold-filling orientation, due to positioning of trunnions 104*a*, 104*b* relative to the center of gravity of the mold 100, or alternatively or in addition by use of counterweights or heavier materials placed on one or more walls of mold 100 which adjust the center of gravity of the mold 100 relative to the trunnions 104*a*, 104*b*, mold 100 will be caused to rotate about the trunnions 104*a*, 104*b* so that the front wall 108 of the mold 100 faces downwards; i.e., when the mold 100 is resting on a flat surface such as a floor, the front wall 108 is pressing against the flat surface. In other words, when the mold 100 is empty and is supported by the trunnions 104*a*, 104*b*, the center of gravity of the mold 100 is such that it causes the mold 100 to pivot about the trunnions 104*a*, 104*b* such that the front wall 108 faces downwards and the rear (open) side 114 of the mold 100 faces upwards in mold-filling position, and as discussed in greater detail below with respect to FIGS. 11 to 14. In such position liquid concrete can be poured into the interior of the mold through the rear side 114.

Once the concrete has cured in mold 100 and the block 300 is ready to be removed, the mold 100 is raised by lifting the trunnions 104*a*, 104*b*, so as to cause the mold to be raised from its position resting on a flat surface such as a floor, whereupon due to the altered (new) center of gravity of the mold 100 and formed block 300 therein, is caused to rotate 90° about trunnions 104*a*, 104*b* so as to transition to the block-removal orientation, as more fully described below. Specifically, in such block-removal orientation, mold 100 when such concrete is poured therein, is configured such that with the added concrete the center of gravity of the mold 100 and block 300 therein is such that, when mold 100 is raised by lifting on each of trunnions 104*a*, 104*b*, the mold 100 pivots about trunnions 104*a*, 104*b*, such that top side 110 of the mold 100 faces upwards and the front side 108 of the mold 100 accordingly faces forwards. Also as discussed in greater detail with respect to FIGS. 11 to 16 below, the resulting rotation to the block-removal position advantageously then allows the hollow core insert 112 to be lifted via hooks 175*a*, 175*b* vertically out of the mold 110, thereby leaving a hollow portion 313 within block 300 as shown in FIG. 15, and further allows for the block 300 itself to be lifted out of the mold 100, as shown in FIG. 14.

Figure 8A:
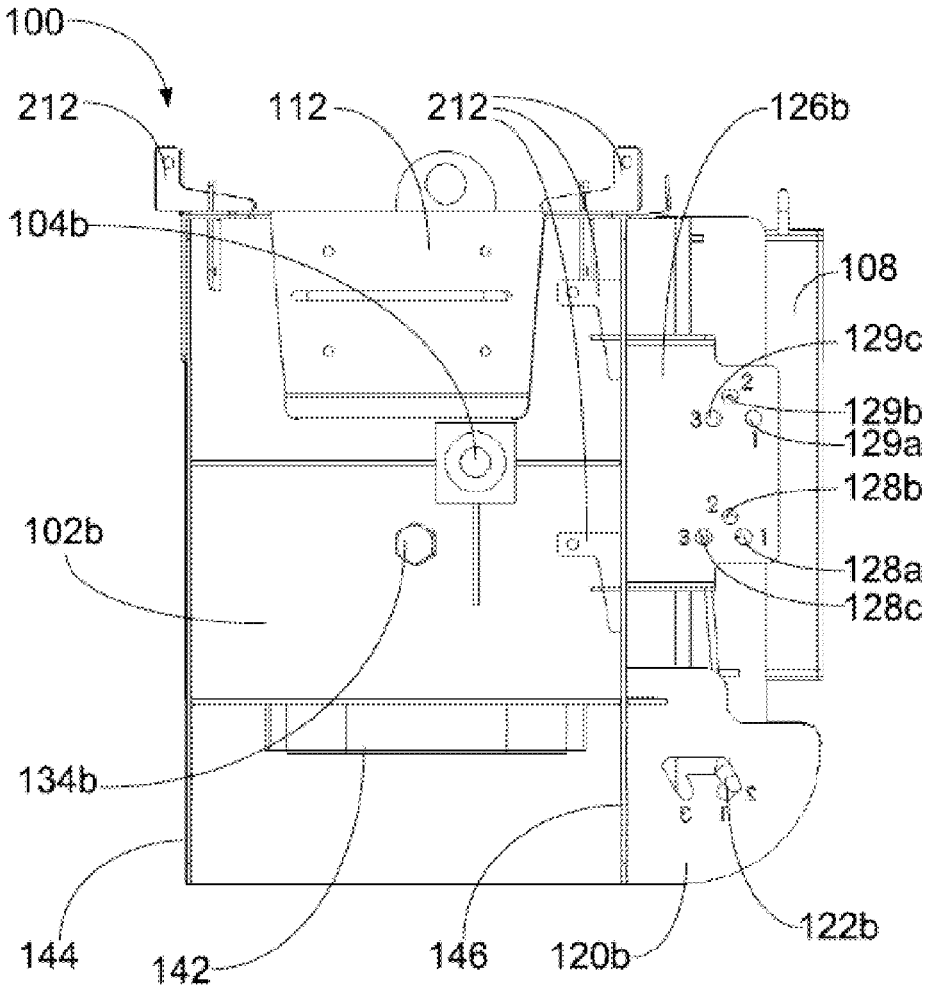
FIG. 8(*a*) is a left side elevation view of the mold of FIG. 1.
Figure 8B:
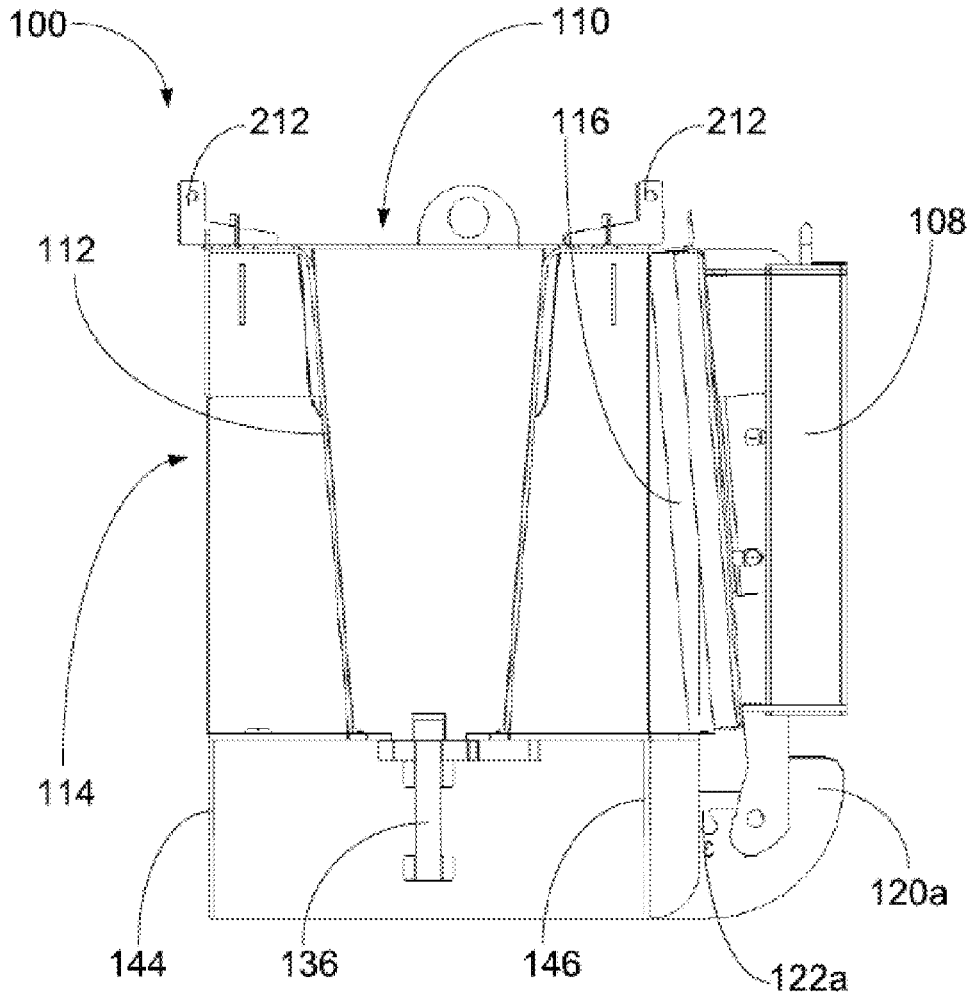

In a preferred embodiment, in order for the mold 100 to transition between the mold-filling and block-removal orientations, the trunnions 104*a*, 104*b* are mounted to the side walls 102 in substantial vertical alignment with, but above, the center of gravity (not shown) of the mold 100 and block 300 therein, to ensure mold 100 will rotate, when the mold 100 is lifted by trunnions 104*a*, 104*b*, to be in the block-removal position shown in FIGS. 7*a* and 8*a*. The mold 100 may be counter-weighted by having weights attached thereto, and/or the trunnions 104*a*, 104*b* further positioned, to adjust the center of gravity of the mold 100 when empty, such that when the front wall 108 of the mold 100 is closed and the mold 100 is empty after block 300 has been removed, suspending the mold 100 by the trunnions 104*a*, 104*b* will result in the mold 100 rotating about the trunnions 104*a*, 104*b* towards mold-filling orientation as shown in FIG. 5. Assuming the mold 100 is suspended high enough to allow the mold 100 to rotate 90°, once the mold 100 has rotated approximately 90° it can be lowered into the mold-filling orientation as shown in FIGS. 7(*a*) and 8(*a*).

After liquid concrete is poured into the mold 100 when in the mold-filling orientation and the block has cured and is ready to be removed, the mold 100 can again be suspended by the trunnions 104*a*, 104*b*. Because of the position of the center of gravity of the mold 100 has changed due to the added concrete, the altered distribution of mass in the mold 100 will cause, when suspending the mold 100 by the trunnions 104*a*, 104*b*, the mold 100 to rotate from the mold-filling orientation back to the block-removal orientation. When transitioning back to the block-removal orientation, the mold 100 rotates in a direction opposite to the direction in which it initially rotated from the block-removal orientation to the mold-filling orientation. Note that in the preferred embodiment, due to the position of the trunnions 104*a*, 104*b* and the positioning of counterweights if needed, regardless of what side of the mold is facing upwards, when the mold is empty and suspended by the trunnions, it rotates into the mold-filling orientation shown in FIGS. 5 and 12.

Additionally, because the center of gravity of the mold 100 changes when filled, the density of the concrete or whatever liquid is used to be used fill the mold 100, is taken into consideration when positioning the trunnions 104*a*, 104*b* on the mold 100, so as to achieve the ±90° desired rotation of the mold 100 when raised via the trunnions 104*a*, 104*b*, from the mold-filling position to the block-removal position, and vice versa. Alternatively, provision may be made on the mold to attach counterweights, to account and variably adjust for materials of different densities, in order to adjust the center of gravity in the unfilled and/or filled position, so as to achieve the desired ±90° rotation of the mold 100 when raised via the trunnions 104*a*, 104*b*, from the mold-filling position to the block removal position, and vice versa.

Although in a preferred embodiments the positioning the trunnions 104*a*, 104*b* and/or the relative positioning of counterweights to achieve the ±90° desired rotation of the mold 100 from the mold-filling position to the block removal position can easily be determined and is dependent on the location of the center of gravity of the entire mold 100 in both filled and unfilled conditions, in alternative embodiments different ways of adjusting the center of gravity of the mold 100 can be employed achieve the ±90° desired rotation of the mold 100 from the mold-filling position to the block removal position upon lifting of the mold 100 via trunnions 104*a*, 104*b*. For example, different portions of the mold 100 can be made of materials of different density so that even if the trunnions 104*a*, 104*b* are mounted in the center of the side walls 102, the mold 100 can be transitioned between the block-removal and mold-filling orientations as described above. Alternatively, the shape of the block 300 (and thus the shape of mold 100) can be adjusted to adjust the center of gravity of the mold in both the filled and unfilled conditions to thereby achieve the ±90° desired rotation of the mold 100 from the mold-filling position to the block removal position upon lifting of the mold 100 via trunnions 104*a*, 104*b*. Alternatively, as mentioned above, counterweights can be added to or removed from the mold 100 so as to cause it to rotate the mold 100 in one direction or another, depending if mold 100 is in the filled or unfilled position. Any combination of the foregoing can be used to adjust the center of gravity of the mold 100, as desired, in order to achieve the +90° desired rotation of the mold 100 from the mold-filling position to the block removal position, and the reverse −90° desired rotation from the block removal position to the mold-filling position once the block 300 has been removed.

The bottom wall 106 of the mold 100 includes protruding feet-forming members 142 into which concrete can flow so that the feet 143 formed thereby are insertable into the hollow core 302 of another block 300 on which said block 300 may be stacked, as shown in FIG. 15. The feet 143 can therefore be used to securely stack the blocks 300 to form a wall 400, as shown in FIG. 16.

The bottom wall 106 of mold 100 also has a removal screw 136 extending through it, which can be used to facilitate the block-removal process. More particularly, when the block is ready to be removed from the mold 100, and elongate threaded removal screw 136 can be threadably inserted via a threaded number not identified by number on bottom wall 146 into the interior of the mold 100, where it abuts against the hollow core insert 112. Continued rotation of the removal screw 136 into the mold 100 bows bottom wall 106 thereby separating it from the block, and can further help to push the hollow core insert 112 out of the mold 100 and which can be of assistance to lifting the block out of the mold 100.

Figure 11:
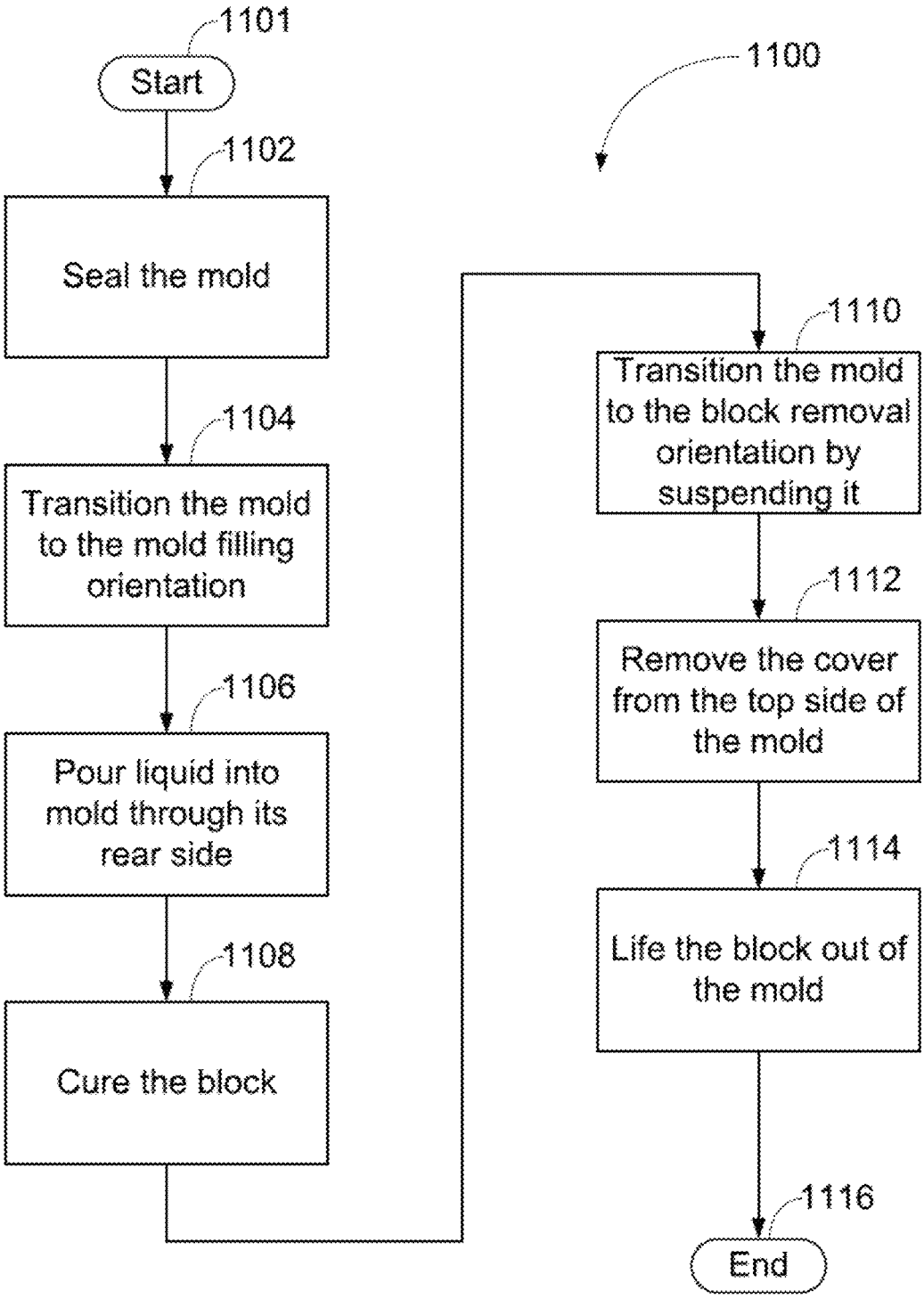
FIG. 11 is a method for making a block, according to another embodiment.

Referring now to FIG. 11, in another embodiment of the invention there is shown a method 1100 for making a block, according to another embodiment. Performing the method 1100 is described with reference to FIGS. 12 to 14.

At block 1101, the method 1100 begins with the mold 100 in the block-removal orientation. The method proceeds to block 1102 where the mold 100 is sealed. Sealing the mold 100 involves moving the front wall 108 into the closed position and inserting the hollow core insert 112 into the mold 100 through its top side 110. The front wall 108 and the hollow core insert 112 are then fastened in position using the wedge and pin fastening system. Although the depicted embodiments utilize the hollow core insert 112 to cover the top side 110, in an alternative embodiment (not depicted) any suitable type of cover can be used as a cover for the top side 110 so long as it prevents liquid concrete from escaping through the top of the mold 100. For example, in an embodiment in which solid core concrete blocks are manufactured, a flat metal plate can be used in place of the hollow core insert 112.

Following sealing, the mold 100 is transitioned to the mold-filling orientation at block 1104. As described above, to perform this transition the mold is suspended by the trunnions 104 sufficiently high to allow the mold 100 to rotate such that the front wall 108 faces downwards. Although in the method 1100 the mold 100 begins in the block-removal orientation, in alternative embodiments (not shown) the mold 100 may begin in an alternative orientation, such as with the front wall 108 facing upwards. In an alternative embodiment (not shown) in which the mold 100 begins in the mold-filling orientation at block 1100, then block 1104 may be bypassed.

Figure 12:
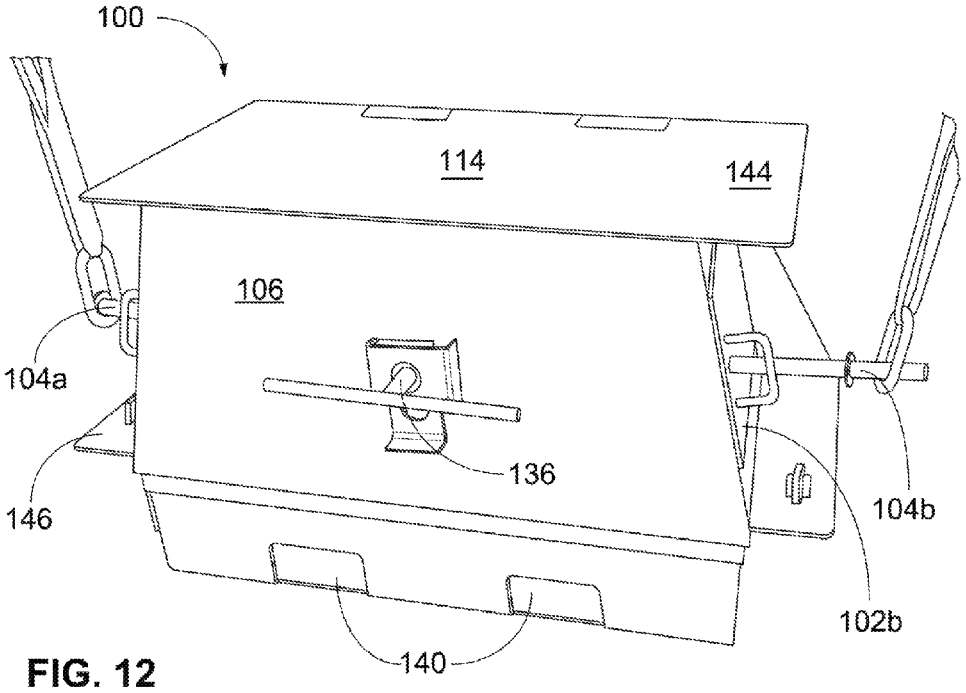
FIG. 12 is a perspective view of a mold for making a hollow core concrete block, in which the mold is shown as being in a mold-filling orientation. (i.e. rotated on its side due to gravity in mold-filling position)

Once the mold 100 is in the mold-filling orientation, liquid concrete is poured into the mold 100 through the open rear side 114. FIG. 12 depicts the mold 100 in the mold-filling orientation once it has been filled with liquid concrete. Once the mold 100 is filled, the concrete is allowed to cure at block 1108. Optionally, the mold 100 may be placed on a vibration table and shaken during the curing process to cause air bubbles within the concrete to rise to surface and dissipate.

Following curing, the block is removed from the mold 100. At block 1110, the mold 100 is again suspended by the trunnions 104 so as to cause the mold 100 to transition to the block-removal position. As discussed above, the center of gravity of the mold 100 changes once it is filled with concrete, and accordingly suspending it by the trunnions 104 causes the mold 100 to rotate in the block-removal orientation as opposed to staying in the mold-filling orientation. The top side 110 of the mold 100 is then uncovered at block 1112; when the mold 100 is being used, this corresponds to removing the hollow core insert 112 from the top side 110 of the mold 100 at block 1112. In embodiments in which the front wall 108 of the mold 100 is lined with the textured surface 116 and is movable, the front wall 108 is also moved once the mold 100 is in the block-removal orientation such that the textured surface 116 does not interfere with removal of the block from mold 100. FIG. 13 shows the mold 100 with a cured concrete block therein, with the hollow core insert 112 removed from the mold 100 and the front wall 108 pivoted into the opened position.

Following block 1112, the block 300 can be lifted out of the mold 100 via the hooks 175*a*, 175*b* in the block 300 resulting from the hook portions 138 in the hollow core insert 112. FIG. 14 shows the block 300 being lifted out of the mold 100. After the block 300 has been removed from the mold 100 the method 1100 ends at block 1114.

The mold 100 may be made from any suitable material, such as stainless steel or another metallic alloy or a polymer.

FIG. 11 is a flowchart of an exemplary method. Some of the blocks illustrated in the flowchart may be performed in an order other than that which is described. Also, it should be appreciated that not all of the blocks shown in the flow chart are required to be performed, that additional blocks may be added, and that some of the illustrated blocks may be substituted with other blocks.

While particular embodiments have been described in the foregoing, it is to be understood that other embodiments are possible and are intended to be included herein. It will be clear to any person skilled in the art that modifications of and adjustments to the foregoing embodiments, not shown, are possible.

The invention claimed is:

1. A mold for making a block, said mold having an altered center of gravity when filled with a material as compared to when empty, wherein said altered center of gravity causes rotation of the mold by approximately 90° from a mold-filling orientation to a block-removal orientation, to facilitate removal of said block from within the mold, the mold comprising:

(a) two opposing side walls each having a trunnion aligned on a common axis about which the mold is rotatable, each of said trunnions extending away from an interior of the mold, wherein the trunnions are positioned on the side walls such that when the mold is filled with said material and suspended by said trunnions the mold rotates about said trunnions from said mold-filling orientation to said block-removal orientation;

(b) a bottom wall sealingly engageable with the side walls;

(c) a front wall sealingly engageable with the bottom and side walls, said front wall when said mold is in the mold-filling orientation being on a bottom of the mold and when the mold is in the block-removal orientation said front wall is rotated to a front of said mold;

(d) a removable cover which sealingly engages the side walls and which forms a top side of the mold, wherein the top side faces upwards when the mold is in the block-removal orientation and said cover can be removed when the mold is in said block-removal orientation to permit removal of said block from said mold; and (e) a rear side through which said material can be introduced into the mold, wherein the rear side is on a top of the mold and faces upwards when the mold is in the mold-filling orientation and rotates approximately 90° to a rear of said mold when the mold is in the block-removal orientation;

wherein the center of gravity of the mold when empty is offset from the common axis about which the mold is rotatable such that gravity causes the mold to pivot about the common axis to the mold-filling orientation when the mold is empty and supported by the trunnions, and wherein the altered center of gravity is offset from the common axis about which the mold is rotatable such that gravity causes the mold to pivot about the common axis to the block-removal orientation when the mold is filled with the material and supported by the trunnions.

2. A mold as claimed in claim 1 wherein the front wall comprises a textured surface and is movable between a sealed position in which the front wall is sealingly engaged with the bottom and side walls and the textured surface extends into the interior of the mold and an opened position in which the front wall and the bottom and side walls are unsealed and the textured surface is outside the interior of the mold.

3. A mold as claimed in claim 2 wherein the front wall is pivotably coupled to the bottom wall and is pivotable between the sealed and opened positions.

4. A mold as claimed in claim 3 further comprising:

(a) a pair of pivot pins fixedly coupled on opposing sides of the front wall about which the front wall is pivotable; and (b) a pair of pivot plates coupled to the side walls and between which the front wall is positioned, each of the pivot plates having a slot through which one of the pins is insertable and along which one of the pins is slidable along a portion of the distance between the front wall and rear side, wherein said slot has a plurality of spaced-apart notches therein to allow positioning of said one of said pins therein to thereby allow adjustable angle of inclination of said front wall.

5. A mold as claimed in any one of claims 3 or 4 further comprising a pair of batter draft pins fixedly coupled on opposing sides of the front wall and wherein each of the side walls further comprises an adjustable batter draft plate having apertures positioned to receive the batter draft pins, each of the apertures corresponding to a different batter draft angle or thickness of the block.

6. A mold as claimed in any one of claims 1, 2, or 3 wherein the removable cover comprises a hollow core insert insertable into the mold.

7. A mold as claimed in any one of claims 1, 2, or 3 further comprising a threadably removable lug insertable through at least one of the side walls to allow air into the mold during removal of the block.

8. A mold as claimed in any one of claims 1, 2, or 3 further comprising a removal screw insertable through the bottom wall, adapted when threadably inserted to bow one or more walls of the mold to assist in removal of the block from the mold.

9. The mold as claimed in anyone of claims 1, 2, or 3, further comprising a removal screw insertable through the bottom wall when the removable cover is sealingly engaged on the top side and a hollow core extends into the mold, adapted when threadably inserted to push the hollow core from within the mold.

10. A mold as claimed in any one of claims 1, 2, or 3 wherein the removable cover comprises hook portions shaped such that the block is formed with hooks for pulling the block out of the mold.

11. A mold for making a block, said mold having an altered center of gravity when filled with a material as compared to when empty, wherein said altered center of gravity causes rotation of the mold by 90° from a mold-filling orientation to a block-removal orientation to facilitate removal of a formed block from within the mold, the mold comprising:

(a) two opposing side walls, each having a trunnion aligned on a common axis about which the mold is rotatable, each of said trunnions extending away from an interior of the mold, wherein the trunnions are positioned on the side walls such that the center of gravity of the mold, when the mold is suspended by the trunnions and when empty, rotates the mold towards the mold-filling orientation, and when said mold is filled with said material said altered center of gravity tends to rotate the mold 90° from the mold-filling orientation to said block-removal orientation;

(b) a bottom wall sealingly engageable with the side walls;

(c) a wall sealingly engageable with the bottom and side walls and having a textured surface lining the interior side thereof, said wall when said mold is in the mold-filling orientation being on a bottom of the mold, and when the mold is in the block-removal orientation said wall being rotated to a front of said mold, to thereby allow said wall to be removed from said sealing engagement with said side walls when said block is desired to be removed from said mold, wherein the wall is pivotable between a closed position in which the wall is sealingly engaged to the side and bottom walls and an opened position in which the wall is parallel to the bottom wall;

(d) a top side, wherein the top side faces upwards when the mold is in the block-removal orientation;

(e) a hollow core insert insertable into the mold through the top side and sealingly engageable with the side and front walls which can be removed when the mold is in said block-removal orientation to permit removal of said block from said mold; and (f) a rear side through which the material can be placed into the mold, wherein the rear side faces upwards when the mold is in the mold-filling orientation and rotates 90° to a rear of said mold when the mold is in the block-removal orientation;

wherein the center of gravity of the mold when empty is offset from the common axis about which the mold is rotatable such that gravity causes the mold to pivot about the common axis to the mold-filling orientation when the mold is empty and supported by the trunnions, and wherein the altered center of gravity is offset from the common axis about which the mold is rotatable such that gravity causes the mold to pivot about the common axis to the block-removal orientation when the mold is filled with the material and supported by the trunnions.

12. The mold as claimed in claim 1 wherein the cover comprises a hollow core insert and wherein said center of gravity when said mold is empty causes said mold, when said block and hollow core insert are removed therefrom and when said mold is supported by the trunnions, to rotate toward and to said mold-filling orientation.

* * * * *